US005596821A

United States Patent [19]

Solo

[11] Patent Number: 5,596,821

[45] Date of Patent: Jan. 28, 1997

[54] UTILITY ARTICLE ATTACHABLE TO FOOTWEAR

[76] Inventor: Alan J. Solo, 1835 Burnett St., Brooklyn, N.Y. 11229

[21] Appl. No.: 493,320

[22] Filed: Jun. 21, 1995

[51] Int. Cl.[6] ..... A43B 23/00

[52] U.S. Cl. ..... 36/136; 36/137; 206/37.1; 206/37.4

[58] Field of Search ..... 36/136, 132, 137; 206/37.1, 37.4, 38.1, 459.1; 224/42.11, 429, 430

[56] References Cited

U.S. PATENT DOCUMENTS

| | | | |
|---|---|---|---|
| 2,405,744 | 8/1946 | Glass | 224/430 |
| 2,662,677 | 12/1953 | Perry | 36/136 |
| 2,698,639 | 1/1955 | Bottomley | 206/38.1 |
| 2,813,602 | 11/1957 | MacArthur, Jr. | 224/42.11 |
| 4,280,287 | 7/1981 | Gulbransen | 36/136 |
| 4,507,882 | 4/1985 | Harrell | 36/136 |
| 4,573,573 | 3/1986 | Favaro | 206/305 |
| 4,712,319 | 12/1987 | Goria | 36/137 |
| 5,094,016 | 3/1992 | DiVito | 36/136 |
| 5,129,102 | 7/1992 | Solo . | |
| 5,184,762 | 2/1993 | Nevitt | 224/148 |
| 5,379,491 | 1/1995 | Solo . | |

FOREIGN PATENT DOCUMENTS

| | | | |
|---|---|---|---|
| 2139103 | 11/1984 | United Kingdom | 36/132 |

*Primary Examiner*—Ted Kavanaugh
*Attorney, Agent, or Firm*—Lackenbach Siegel Marzullo Aronson & Greenspan, P.C.

[57] ABSTRACT

A utility article attachable to footwear, including, for example, shoes, sneakers, skates, and the like, includes a central, generally planar portion which can be removably secured to the item of footwear by a pair of holes or elongate slots through which the ends of shoe laces or attachment straps can pass and be connected in a conventional way. Securing the central portion to the item of footwear causes two lateral or side portions to press or abut against the item of footwear. An embodiment is disclosed in which the side portions include pockets or compartments for storing personal articles, such as a key, money or identification. When storage pockets are provided, flaps are used to selectively open or close the same. Opening of the flaps provides access to the compartments in the pockets and cup portions are preferably provided which provide a cavity or recess when the flaps are opened to facilitate the placement of a finger underneath the personal item and its removal from the pockets. The article, with or without the .side pockets, is preferably formed of a plastic material which includes a phosphorescent or luminescent additive which makes the article glow at night. Optional reflectors are preferably used for enhancing the safety of the user at night. The article, with or without the pockets, is also advantageously provided with one or more writing surfaces on which identifying information may be written.

20 Claims, 4 Drawing Sheets

FIG. 1
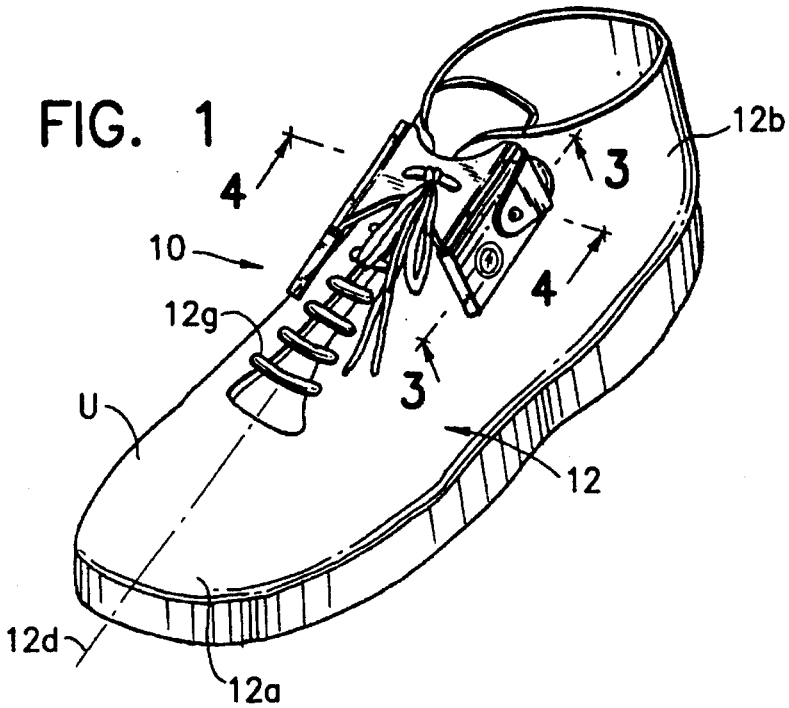
FIG. 2
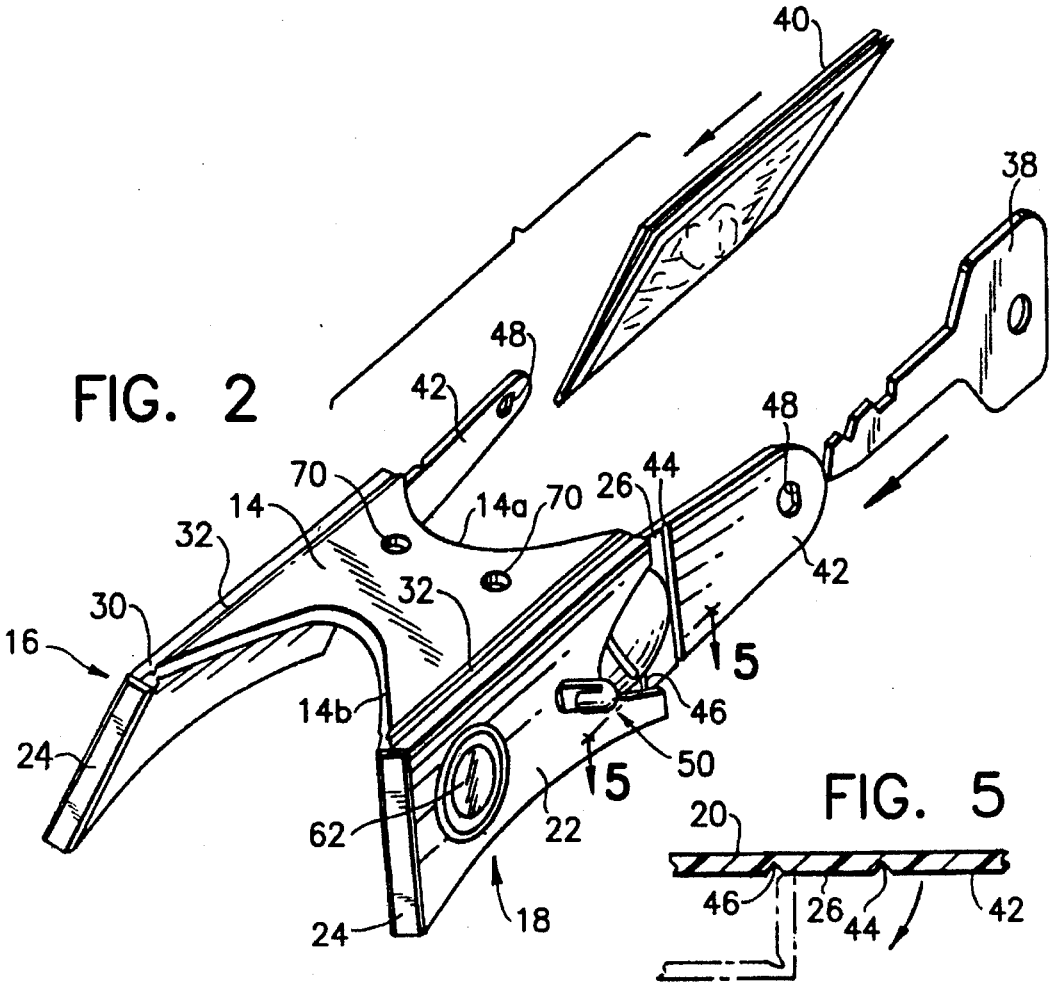
FIG. 5

UTILITY ARTICLE ATTACHABLE TO FOOTWEAR

BACKGROUND OF THE INVENTION

The invention generally relates to footwear accessories and, more specifically, to a utility article attachable to footwear.

Devices for removably securing functional items to support articles are known. For example, in U.S. Pat. No. 5,379,491, issued to the inventor of the present invention, a mounting arrangement is disclosed for removably securing conventional items, such as flip-up and down glasses, compasses, pedometers, pouches, purses, cases, clips and the like. The device is disclosed as being used in a number of different ways for attaching, for example, articles to a hat, head band, an article of clothing. Other examples are given. This patent also discloses the use of the holding device to secure a pouch on footwear such as a sneaker. The device is intended for attachment of a pouch or carrying case to the footwear to hold identification of the wearer, key, money or other items the wearer desires to have on his person. However, the pouch is secured to one or the other side of the shoe which renders the item difficult to see under some conditions. Additionally, because the pouch or carrying case is merely held to the footwear by means of hook and loop ("Velcro") tape fastener, the pouch or carrying case can be pulled off or simply fall off during running or heavy activity. Attention is also made to U.S. Pat. No. 5,129,102, also issued to the inventor of the subject invention, which discloses a cap provided with removable flip up and down glasses.

While accessories have also been proposed for footwear for providing storage means for containing identification, money, etc., such accessories have generally been secured to the footwear in a manner which allows the pouch or case to flop around during heavy activity or running. Aside from providing a storage compartment, some of these prior art devices have served no other functions.

SUMMARY OF THE INVENTION

Accordingly, in order to eliminate disadvantages inherent in prior art footwear accessories of this type, it is an object of the present invention to provide a utility article attachable to footwear which is simple in construction and economical to manufacture.

It is another object of the present invention to provide a utility article attachable to footwear which is easy and convenient to use.

It is still another object of the present invention to provide a utility article as suggested above which can be readily attached to and removed from the footwear.

It is yet another object of the present invention to provide a utility article as suggested in the previous objects which can serve more than one function.

It is a further object of the present invention to provide a utility article as in the previous object which can be used to provide suitable storage compartments for storing small articles, such as keys, money and the like on the body of the person while running, doing exercise or the like.

It is still a further object of the present invention to provide a utility article attachable to footwear which is made of a phosphorescent or luminescent material to glow in the dark.

It is a yet a further object of the present invention to provide a utility article as in the previous objects which includes suitable reflectors for providing safety to the user when used at night.

It is an additional object of the present invention to provide a utility article as suggested above which once mounted on footwear, becomes immobile and does not flop around or move during running or heavy activity.

It is still an additional object of the present invention to provide a utility article as above suggested in the previous objects which can be utilized with numerous types of footwear, including footwear using laces, skates using straps and the like.

In order to achieve the above objects, as well as others which will become apparent hereafter, a utility article in accordance with the present invention is attachable to footwear having an upper which has a central section and side sections one on each side of the central section. The utility article comprises a generally planar central portion and two side portions one on each side of said central portion. Attachment means is provided on said central portion for detachably attaching said central portion to the central section of the shoe upper. Said two side portions are arranged in planes inclined at angles relative to the plane of said central portion to configure the utility article generally in a U-shape to form a shoe receiving space for receiving the shoe upper. Said central portion is dimentioned and said side portions are inclined at angles selected to cause said side portions to straddle and abut against corresponding side sections of the shoe upper when said central portion is secured to the central section of the shoe upper to securely attach the utility article to the shoe during normal use.

In accordance with one presently preferred embodiment, the side portions each include a pocket suitable for storage of an item to be carried. In another embodiment, the two side portions simply provide planar surfaces on which reflectors may be mounted, or on which writing surfaces may be provided for inscribing the identification of the user.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 1 is a perspective view of a laced shoe on which a utility article in accordance with the present invention is mounted;

FIG. 2 is an enlarged perspective view of the utility article as shown in FIG. 1, shown with the side pockets flaps open in positions providing access to the interiors of the side pockets, and illustrating the manner in which articles can be inserted therein, including a key and paper identification or paper money;

FIG. 5 is a fragmented cross sectional view of one of the side pockets as shown in FIG. 2 taken along line 5—5, illustrating the plastic hinges for facilitating the opening and closing of the pocket flap, the open condition being shown in solid outline and the closed position being shown in phantom outline;

DESCRIPTION OF THE PREFERRED EMBODIMENTS

Figure 3:
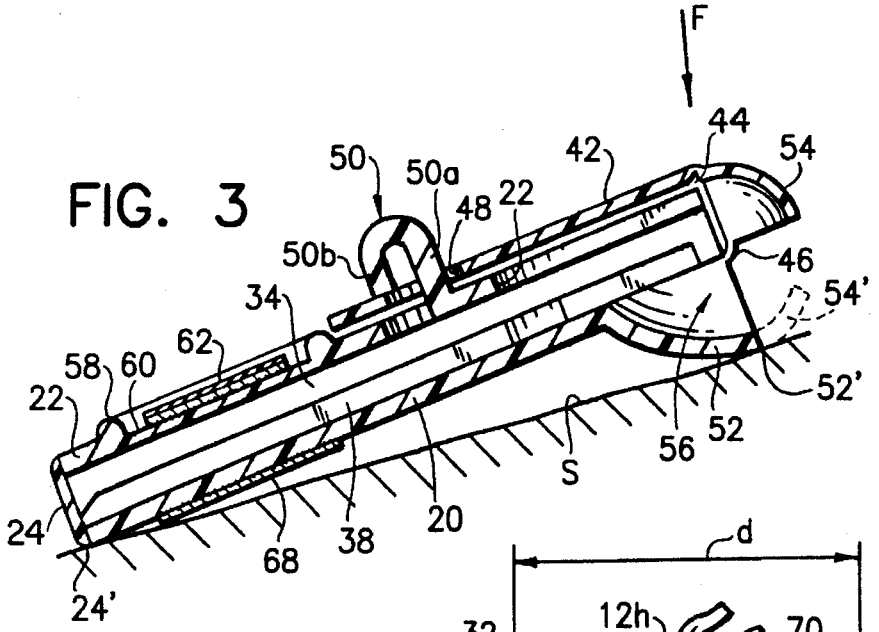
FIG. 3 is an enlarged cross sectional view of the utility article as shown in FIG. 1, taken along line 3—3.

Referring to the figures in which the identical or similar are designated by the same reference numerals throughout, and first referring to FIG. 1, a utility article in accordance with the present invention is generally designated by the reference numeral 10. The utility article 10 is shown mounted on a casual shoe or sneaker 12. However, it will become apparent from the discussion that follows that the utility article can be used with any item of footwear.

To facilitate a description of the utility article 10, it is helpful to define the shoe 12 as having a front portion 12*a* and a back or rear portion 12*b*. Also referring to FIG. 4, the shoe 12 has an upper U which includes a central section 12*c* which generally defines a line of symmetry 12*d* (FIG. 1) and side or lateral sections 12*e* and 12*f*.

The utility article 10 includes a generally planar central portion 14 which is intended to be placed over the central section 12*c* of the upper U and generally centered in relation to the line symmetry 12*d*. However, the precise position of the central portion 14 (FIG. 2) is not critical.

Figure 4:
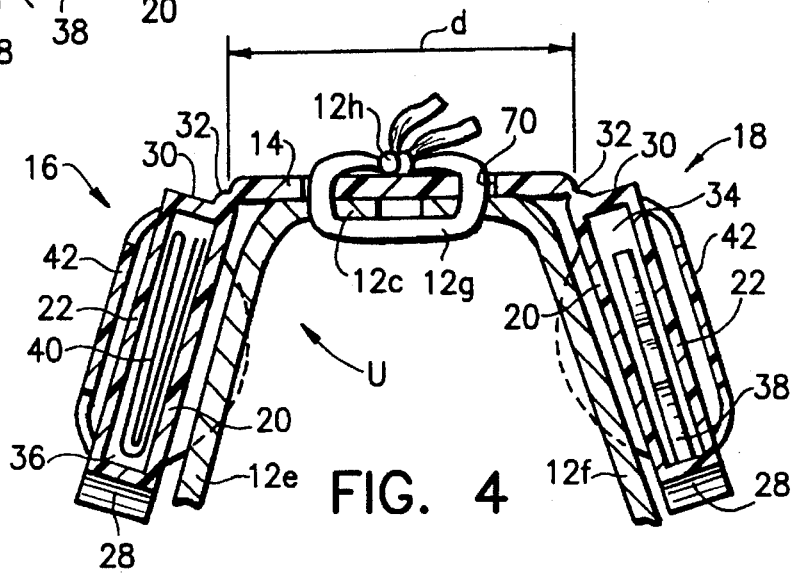
FIG. 4 is an enlarged cross sectional view of the utility article as shown in FIG. 1 taken along line 4—4.
Figure 6:
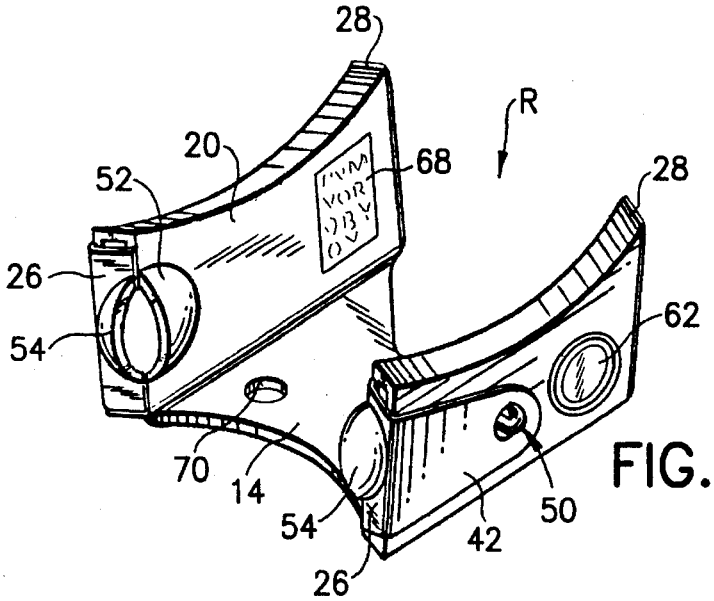
FIG. 6 is perspective view of the utility article shown in FIG. 2, as viewed from the other side to illustrate the shoe receiving space or cavity formed by the various portions of the utility article.

Two lateral or side portions 16, 18 are provided one on each side of the central portion 14 in the embodiment shown in FIGS. 1–8. The side portions 16, 18 are in form of pockets or compartments for carrying or storing small personal items. Referring to FIGS. 2–4, the side pocket 18, for example, is shown formed of a bottom wall 20 spaced from an upper wall 22 to provide sufficient space therebetween for the intended item to be carried. The pocket is closed off at one end by lower end wall 24 and upper end wall 26 (FIG. 6). The sides of the pockets are closed by side walls 28 and 30 as shown (FIG. 2).

The side portions or pockets 16 and 18 are integrally formed with the central portion 14 and preferably attached by plastic hinges 32 which allow relative changes in positions of the side sections in relation to the central section. However, the plastic hinges 32 may not be necessary if the article 10 is made of sufficiently soft or pliable material.

As suggested, the dimensions of the various walls forming the side pockets can be modified to provide internal spaces or compartments 34, 36 of adequate size to accommodate desired articles to be carried. Thus, referring to FIG. 4, a compartment or space 34 in the side pocket 18 is shown to have a thickness less than that of the space for compartment 36 in the side pocket 16. The side pocket 18 can, for example, be dimentioned to accommodate a key 38 with little clearance so that the key has the least amount of space within which to move around. The space 36 in the side pocket 16 is shown somewhat larger to accommodate a folded item of identification or folded money or currency 40.

In order to retain personal articles within the compartments 16, 18 there are provided pocket flaps 42 which form extensions of the bottom wall 20. As shown in FIGS. 2, 5, and 6 an extension of the bottom wall 20 forms the upper end wall 26 as well as the pocket flap 42, these being separated by plastic hinges 44, 46. The flap 42 is shown open in the solid position in FIG. 5, while the closed position is shown in phantom outline.

The flap 42 is preferably provided with means for closing and maintaining the flap closed during use. Such closure means includes a hole 48 in the flap 42 and a latch or a fastener generally designated by the reference numeral 50. Referring more specifically to FIG. 3, the latch 50 comprises a generally hook-shaped configuration having a long leg 50*a* attached to the top wall 22 of the pocket and a shorter leg 50*b* which forms a free end, as shown. The latch 50 is positioned on a pocket to be received within the hole 48 of an associated flap 42 to be retained by the free end 50*b* of the latch and be released when the legs 50*a*, 50*b* are squeezed together or towards each other to cause the free end 50*b* to clear the flap 42 and pass through the hole 48. It should be clear that this closure means is but one example of numerous that can be used, and the specific closure used for this purpose is not critical.

In accordance with one feature of the invention in connection with the embodiment illustrated in FIGS. 1–6, there is preferably formed an inner cup portion formed at the bottom wall 20 proximate to the upper end wall 26 and an upper cup portion 54 formed in the upper end wall 26, as best shown in FIG. 6. Referring to FIG. 3, the inner cup portion 52 and upper cup portion 54 form indentation means on at least one of the pocket flaps and on the pocket to form a cavity or recess 56 when the flap is opened to bring the upper cup portion 54 into proximity with the inner cup portion 52, as illustrated in phantom outline by the reference numeral 54' in FIG. 3. The cooperation of the cup portions 52, 54 as shown to provide the recess 56 below the item in the pocket facilitates placement of one's finger on both sides of an item stored in the compartment, in this case a key 38. Without such lower cavity or recess 56 it would be significantly more difficult to grip an item contained within the compartment or space 34. In the presently preferred embodiment, each of the cup portions 52, 54 are formed as spherical portions to form a generally hemi-spherical recess when the flap is opened. However, it should be clear that the specific configuration of the cup portions is not critical and cup portions having different geometries, such as ellipsoids, spheroids, paraboloids, can clearly be used, with varying degrees of advantages.

Referring particularly to FIG. 3, the upper wall is shown with an optional annular ridge or projection 58, the interior of which is formed with a recessed area 60 suitable for receiving a reflecting element 62. While the reflecting element 62 is shown to be circular, it is clear that the reflector can be selected to be any shape.

Another feature of the invention is the provision of a writing surface 68 on the utility article, best shown in FIGS. 3 and 6, which permits the user to write down identifying indicia, such as the user's name and address, telephone number, instructions in case of emergency, etc. This information is preferably written with an indelible or permanent marker. While the writing surface 68 is shown on the bottom wall 20, it is clear that such a surface can be provided anywhere else on the utility article.

An important feature of the present invention is the use of attachment means on the central portion 14 for detachably attaching the central portion to the central section 12*c* of the shoe upper U. The two side portions 16, 18 are arranged in planes inclined at angles relative to the plane of the central portion 14, as best shown in FIGS. 2, 4 and 6, to configure the utility article generally in a U-shape to form a shoe receiving space R (FIG. 6) for receiving the shoe upper. The central portion 14 is dimentioned to have a width "d" (FIG. 4) and a side portions 16, 18 are inclined at angles selected to cause the side portions 16, 18 to abut against corresponding side sections 12*e*, 12*f* of the shoe upper when the central portion 14 is secured to the central section 12*c* of the shoe upper to thereby securely attach the utility article to the shoe during normal use.

In the embodiment illustrated, the footwear is in the form of a shoe which uses laces 12*g* to secure the shoe to the feet of the user. The attachment means in this embodiment comprises a pair of holes 70 formed in the central portion 14 and spaced generally equally distantly in relation to the line of symmetry 12*d*. The holes 70 are dimentioned to receive the ends of the shoe laces 12*g*. Since the upper most shoe lace holes are most convenient to be used for securing the central portion 14, an arcuate cutout 14*a* is preferably provided, as shown in FIG. 2 which prevents direct engagement between the central portion 14 and the foot of the user. The arcuate cut out 14*a* prevents undesired contact with the foot of the user which might otherwise impede movements of the user or cause injury. Although it is contemplated that the utility article 10 will normally be connected to the shoe 12 at the upper loop of the laces 12*g*, this is not critical and the item can be mounted using a lower loop. As best shown in FIG. 4, the side sections 12*e*, 12*f* of the upper U generally define predetermined angles with the central sections 12*c*. The side portions of the utility article define angles with the central portions thereof which are less than the predetermined angles. In this manner, securing the central portion 14 in abutment against the central section 12*c* of the upper U causes the angles between the central portion and side portions 16 and 18 to increase to thereby straddle the upper U with the side portions 16, 18 and press into abutment against the side sections of the upper.

In accordance with another feature of the invention, there is advantageously provided a means for angularly raising that portion of the article closest to the ankle of the user in relation to that portion most remote from the ankle to cause at least one edge of the article to be forced against the upper U. In FIG. 4, such means is the inner cup portion 52 which projects downwardly from the bottom wall 20 so as to elevate the upper end of the article above the surface S of the upper. The opposing end of the article remains in contact with the surface S of the upper. When the shoe laces are tightly tied a downward force F (FIG. 3) is applied to the article 10 which causes the apex 52' of the inner cup portion 52 to press against the surface S of the upper, as does the edge 24' of the lower end wall 24. Therefore, the downward force F is concentrated at the two points 24', 52', this causing the article to press with substantial forces against the footwear surface, thereby preventing undesired movements.

The article 10 is preferably formed of a flexible material and the side portions 16, 18 are integrally joined to the central portion 14 along plastic hinges 32 as suggested. The article can, as indicated, be made of a soft or pliable material which may eliminate the need of the plastic hinges 32, 44 and/or 46. Although the material from which the article is formed is not critical, the presently preferred embodiment is formed of polypropylene. Additionally, the article is preferably made of a plastic material with a phosphorescent or luminescent additive material which glows in the dark. Such a feature renders a more pleasing novelty article and enhances safety when used at night and bright colors by day for safety.

Figure 7:
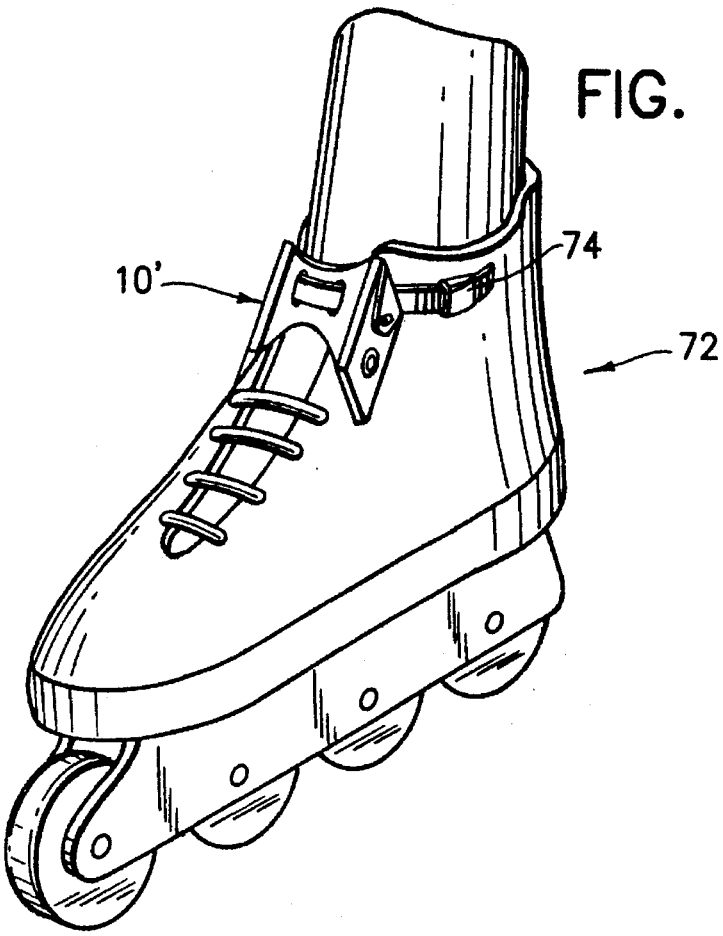
FIG. 7 is a perspective view similar to FIG. 1 but illustrating the utility article of the present invention mounted on a roller-skate.
Figure 8:
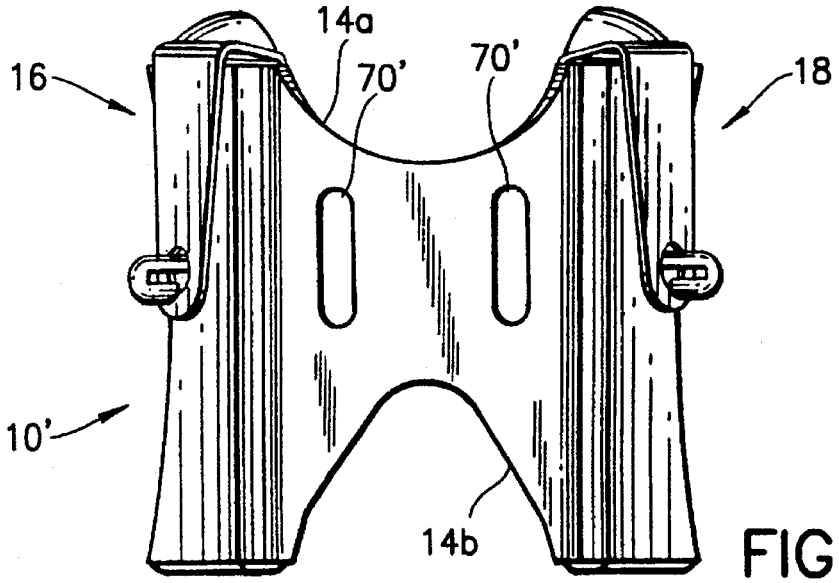
FIG. 8 is a top plan view of the utility article shown in FIG. 7, illustrating the elongate holes dimentioned to receive the strap of the roller-skate shown in FIG. 7.

Referring to FIGS. 7 and 8, a modified utility article 10' is illustrated which is specifically designed to be used with a roller skate 72 which uses a strap 74. The utility article 10' is identical to the article 10 described in FIGS. 1–6, except that the attachment means in the central portion 14 consist of elongate holes 70' which are dimentioned to receive the straps 74.

Figure 9:
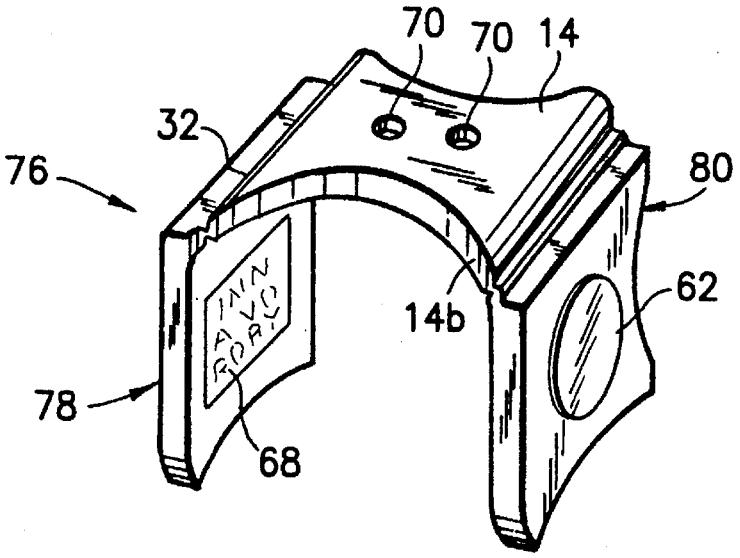
FIG. 9 is perspective view of a modified utility article in accordance with the present invention which does not include side pockets or compartments.

Referring to FIG. 9, an alternate form of the utility article is illustrated which is designated by reference numeral 76. The utility article 76 is substantially the same as the utility article 10, except that no side pockets or compartments are provided. Instead, lateral sections 78, 80 are essentially solid members which are suitable for attachment of reflectors 62 and/or writing surfaces 68. As with the article 10, the utility article 76 is preferably formed of a plastic material, and can be used in the same manner as the utility article 10 when no personal articles need to be carried or stored. The embodiment 76' illustrated in FIG. 10 is similar to the one shown in FIG. 9, except that the article 82 is provided with elongate slots 70' instead of circular holes 70.

Figure 10:
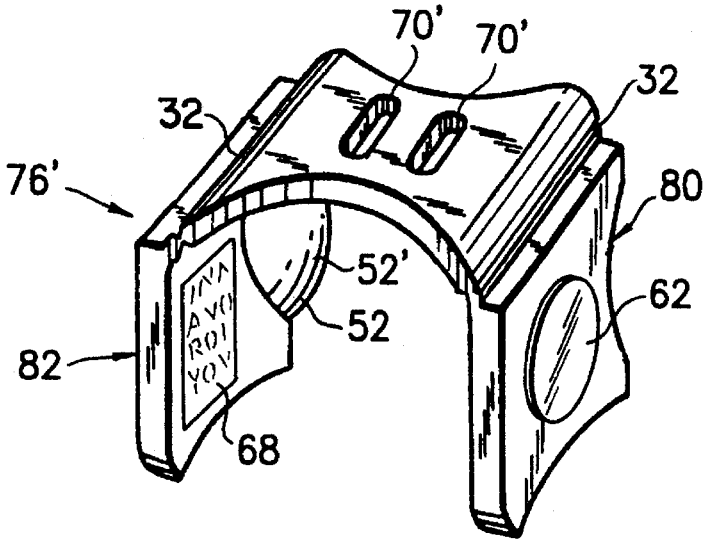
FIG. 10 is generally similar to FIG. 9, but showing elongate slots in the central portions suitable for receiving the straps of a roller-skate.

As indicated in FIGS. 9 and 10, the pocket-free units 76, 76' may be formed with or without cup portions 52. When provided, however these are stationary since they are not attached to movable pockets. Such cup portions 52 can for also provide an apex 52', for reasons discussed in connection with FIG. 3.

Numerous alterations of the above structures herein discussed will suggest themselves to those skilled in the prior art, however, it is to be understand that the present disclosure relates to preferred embodiments of the invention which are for purposes of illustration only and are not to be construed as limitation of the invention.

I claim:

1. Utility article in combination with footwear having an upper which has a central section and two side sections one on each side of said central section, the utility article comprising a generally planar central portion and two side portions one on each side of said central portion; attachment means on said central portion for detachably attaching said central portion to the central section of the shoe upper, said two side portions being arranged in planes inclined at angles relative to the plane of said central portion to configure the utility article generally in a U-shaped to form a shoe-receiving space for receiving the shoe upper, said central portion being dimensioned and said side portions being inclined at angles selected to cause said side portions to abut against corresponding side sections of the shoe upper when said central portion is secured to the central section of the shoe upper to thereby securely attach the utility article to the shoe during normal use.

2. Utility article as defined in claim 1, wherein said central portion and side portions are integrally joined to each other.

3. Utility article as defined in claim 2, wherein the article is formed of a flexible material and said side portions are joined to said central portion along plastic hinges.

4. Utility article as defined in claim 3, Wherein the article is formed of a plastic material.

5. Utility article as defined in claim 4, wherein the article is formed of polypropylene.

6. Utility article as defined in claim 1, wherein each side portion includes a pocket suitable for storage of an item to be carried.

7. Utility article as defined in claim 6 in combination with a key, wherein said pocket defines a space suitable for receiving a key with little clearance.

8. Utility article as defined in claim 7, further comprising a pocket flap associated with each pocket for selectively providing access to said pocket.

9. Utility article as defined in claim 8, further comprising latch means for maintaining said flap in a closed condition.

10. Utility article as defined in claim 9, wherein said latch means comprises a hole in said flap, and generally a hook-shaped latch having a long leg attached to said pocket and a short leg forming a free end, said latch being positioned on a pocket to be received within said hole of an associated flap to be retained by said free end of said latch and be released when said legs are squeezed towards each other to cause said free end to clear said flap and pass through said hole.

11. Utility article as defined in claim 8, further comprising indentation means on at least one of said pocket flaps and said pocket to form a recess when said flap is opened to facilitate placement of fingers on both sides an item stored in a compartment.

12. Utility article as defined in claim 11, wherein said indentation means comprises spherical portions to form a generally hemi-spherical recess when said flap is open.

13. Utility article as defined in claim 1, wherein the footwear are shoes using laces to secure the shoes to the feet of the user, and said attachment means comprises a pair of holes formed in said central portion for receiving the ends of shoe laces.

14. Utility article as defined in claim 1, wherein the footwear are skates using flat straps to secure the skates to the feet of the user, and said attachment comprises a pair of elongate slots formed in said central portion for receiving the flat straps.

15. Utility article as defined in claim 1, wherein the article is formed of a phosphorescent material.

16. Utility article as defined in claim 1, further comprising hinge means for movably connecting each side portion to said central portion.

17. Utility article as defined in claim 16, wherein the article is formed of plastic and said hinge means comprise plastic hinges.

18. Utility article as defined in claim 1, wherein the upper has side sections which generally define predetermined angles with the central section of the upper, said side portions defining angles with said central portion which are less than said predetermined angles, whereby securing said central portion into abutment against the central section of the upper causes said angles between said central and side portions to increase to thereby straddle the upper with said side portions in pressure abutment against the side sections of the upper.

19. Utility article as defined in claim 1, wherein said central portion is provided with an inward cutout between said side portions to provide a clearance with the foot of the user during use.

20. Utility article as defined in claim 1, further comprising means for angularly raising that portion of the article closest to the ankle of the user in relation to that portion most remote from the ankle to cause at least one edge of the article to be forced against the upper, whereby the article is stabilized in relation to the upper when attached thereto.

* * * * *